United States Patent [19]

Jahn et al.

[11] Patent Number: 4,500,562

[45] Date of Patent: Feb. 19, 1985

[54] DI-P-XYLYLENE POLYMER AND METHOD FOR MAKING THE SAME

[75] Inventors: Randy K. Jahn; Raimond Liepins, both of Los Alamos, N. Mex.

[73] Assignee: The United States of America as represented by the United States Department of Energy, Washington, D.C.

[21] Appl. No.: 471,393

[22] Filed: Mar. 2, 1983

[51] Int. Cl.[3] ..... B05D 1/04; B05D 1/06

[52] U.S. Cl. ..... 427/27; 204/168; 204/170; 427/13; 427/41; 528/393

[58] Field of Search ..... 528/393; 526/913; 204/168, 170; 427/13, 27, 41

[56] References Cited

U.S. PATENT DOCUMENTS

| | | | |
|---|---|---|---|
| 3,246,627 | 4/1966 | Loeb et al. | 118/49 |
| 3,300,332 | 1/1967 | Gorham et al. . | |
| 3,301,707 | 1/1967 | Loeb et al. . | |
| 3,429,739 | 2/1969 | Tittman et al. . | |
| 3,491,142 | 1/1970 | Yeh et al. | 260/546 |
| 3,503,903 | 3/1970 | Shaw et al. | 528/393 |
| 3,518,108 | 6/1970 | Heiss et al. | 204/170 |
| 3,573,968 | 4/1971 | Loeb et al. | 111/106 |
| 3,666,533 | 5/1972 | Lee | 427/41 |
| 4,176,209 | 11/1979 | Baker et al. | 427/248 B |
| 4,212,719 | 7/1980 | Osada et al. | 204/168 |
| 4,284,678 | 8/1981 | Jones | 427/160 |
| 4,291,244 | 9/1981 | Beach et al. | 427/41 |
| 4,365,587 | 12/1982 | Hirose et al. | 204/170 |

OTHER PUBLICATIONS

R. Liepins et al., "Plastic Coating of Microsphere Substrates", Jour. Vac. Sci. Technol., 18(3), Apr. 1981.

Gorham, W. F., "A New, General Synthetic Method for the Preparation of Linear Poly-p-Xylylenes", J. Polymer Sci. A-1, vol. 4, p. 3027, (1966).

*Primary Examiner*—Wilbert J. Briggs, Sr.

*Attorney, Agent, or Firm*—William A. Eklund; Paul D. Gaetjens

[57] ABSTRACT

A method and apparatus for forming an improved poly-p-xylylene film. Solid di-para-xylylene dimer is sublimed in a sublimation furnace at approximately 100° to 200° C. and subsequently conducted to a pyrolysis furnace where it is pyrolyzed to the diradical p-xylylene monomer while in the vapor state at approximately 600 degrees C. The diradical monomer is then introduced into a deposition chamber for deposition onto a suitable substrate. The deposition chamber includes electrodes for producing a low pressure plasma through which the diradical monomer passes prior to deposition. The interaction of the diradical monomer with the low pressure plasma results in the formation of poly-p-xylylene film which is exceptionally hard and thermally stable.

10 Claims, 3 Drawing Figures

DI-P-XYLYLENE POLYMER AND METHOD FOR MAKING THE SAME

This invention is the result of a contract with the Department of Energy (Contract No. W-7405-ENG-36).

BACKGROUND OF THE INVENTION

The present invention is generally related to polymeric films and coatings. More particularly, this invention is related to polymerized di-p-xylylene films and coatings, including apparatus and methods for making the same.

It is well known to form films and coatings by pyrolysis and condensation polymerization of di-p-xylylene, which is represented by the structure:

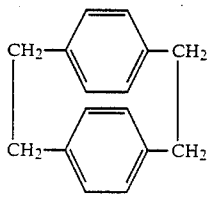

In accordance with the established methods, powdered di-p-xylylene is sublimed at 150° to 200° C. and subsequently pyrolyzed in the gaseous state by heating the sublimed vapor to a temperature of approximately 450° to 700° C. Pyrolysis results in the splitting of the dimer to form the p-xylylene diradical, which is represented by the formula .$H_2C$—AR—$CH_2$.. The diradical monomer is condensable onto a substrate to form a p-xylylene polymer, or poly-p-xylylene, which is a tough, strong and chemically inert film. Depending on the application, the film may be removed from the substrate and used for any desired purpose, or it may be left on the substrate as a protective coating. The polymeric film is commercially available from Union Carbide Corporation under the trademark Parylene. Very thin films of this type, on the order of a micron or less in thickness, are called pellicles.

The process described above can also be applied to the mono- and di-chlorinated di-p-xylylenes to produce chlorinated poly-p-xylylenes, which have slightly different chemical and physical properties making them more or less desirable in specific applications.

The poly-p-xylylene films and coatings are commonly used in optical applications and in the fabrication and protection of electronic components. Additionally, these materials are being used at the Los Alamos National Laboratory in the fabrication of laser fusion targets, which take the form of microscopic spheres containing mixtures of deuterium and tritium. For the latter purpose, it is occasionally necessary to form poly-p-xylylene coatings which are chemically inert, thermally stable at elevated temperatures, and sufficiently hard to permit machining of the polymeric coating into various desired shapes. Commercially available and other previously known poly-p-xylylene polymers have not met these requirements.

SUMMARY OF THE INVENTION

Accordingly, it is the object and purpose of the present invention to provide an improved p-xylylene polymer, including a method and apparatus for making the same.

More specifically, it is an object of the present invention to provide a p-xylylene polymer which is harder, more inert, insoluble in common solvents, and having greater thermal stability than poly-p-xylylene polymers previously available.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention as embodied and broadly described herein, the method of the present invention comprises the steps of subliming a di-p-xylylene, pyrolyzing the di-p-xylylene while in the vapor state to produce what is referred to herein as a p-xylylene vapor, passing the p-xylylene vapor through a low pressure plasma, and condensing the p-xylylene vapor onto a solid substrate. An apparatus for carrying out this method includes sublimation and pyrolysis furnaces for forming the p-xylylene vapor, and a deposition chamber containing electrodes for producing a low pressure plasma around a substrate to be coated.

Any of the substituted or unsubstituted di-p-xylylenes known to be useful for forming polymeric films may be used in the method of the present invention.

The poly-p-xylylene film formed by the process of the present invention is harder, has a higher tensile modulus, and is able to withstand higher temperatures than similar poly-p-xylylene films formed by previously known methods. Additionally, the film of the present invention is insoluble in common organic solvents, unlike the previously known poly-p-xylylene films. It is thought that the exposure of the pyrolyzed p-xylylene vapor to the plasma results in cross-linking in the polymeric condensation product, through mechanisms which are as yet not well understood.

These and other aspects of the invention are more fully set forth in the following more detailed description of the invention.

BRIEF DESCRIPTION OF THE DRAWINGS

The accompanying drawings, which are incorporated in and form a part of the specification, illustrate an embodiment of the apparatus of the present invention and, together with the description, serve to explain the principles of the invention. In the drawings.

DETAILED DESCRIPTION OF THE INVENTION

Figure 1:
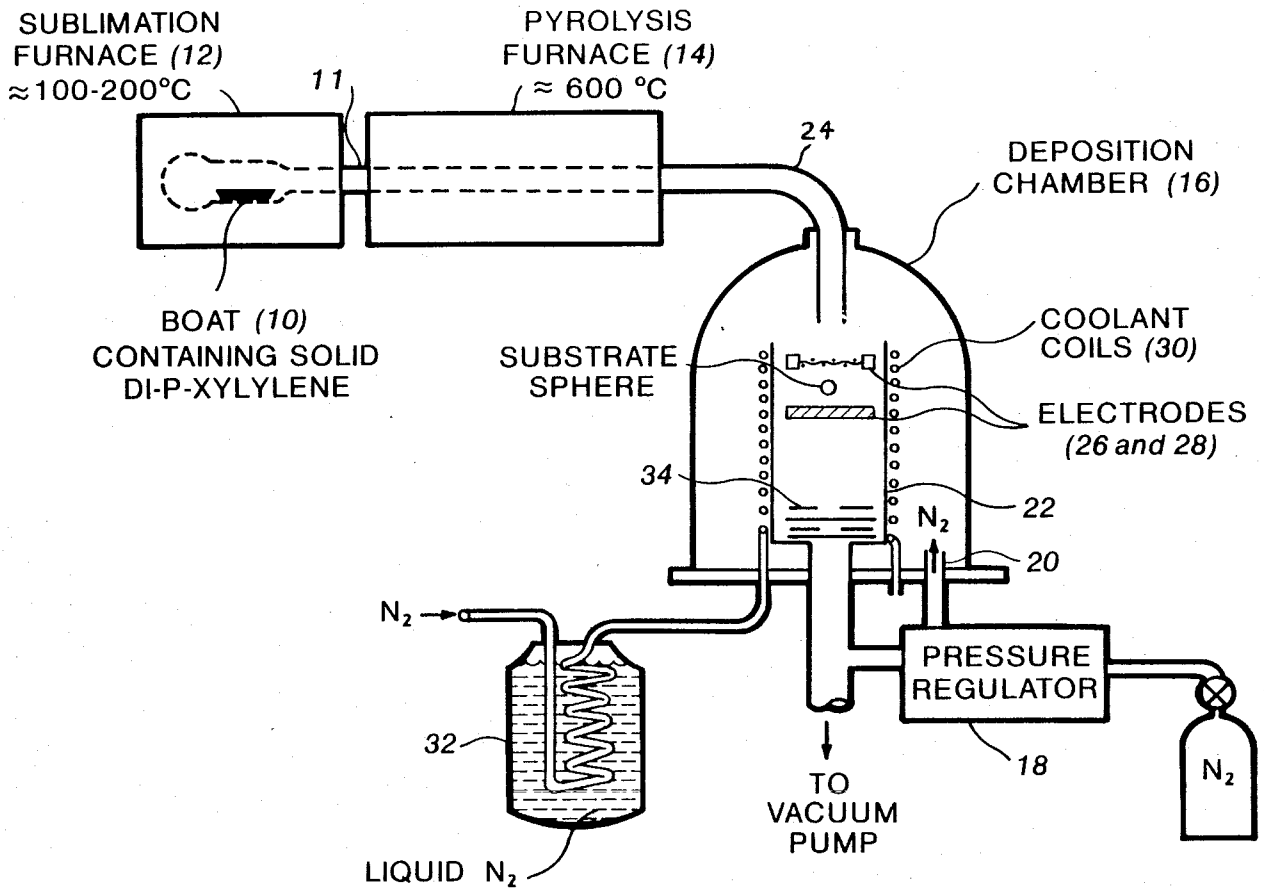
FIG. 1 is a schematic illustration of the apparatus of the present invention which is used to make the improved polymeric poly-p-xylylene film.

Referring to FIG. 1, a charge of di-p-xylylene dimer is contained in an open sample boat 10 which is positioned inside a glass tube 11 that extends through a sublimation furnace 12. The charge is sublimed by increasing the temperature of the sublimation furnace 12 from room temperature to a maximum temperature of approximately 250° C., over a period of time which may range from one hour to several days. The preferred sublimation temperature range is from approximately 100° to 200° C.

Figure 2:
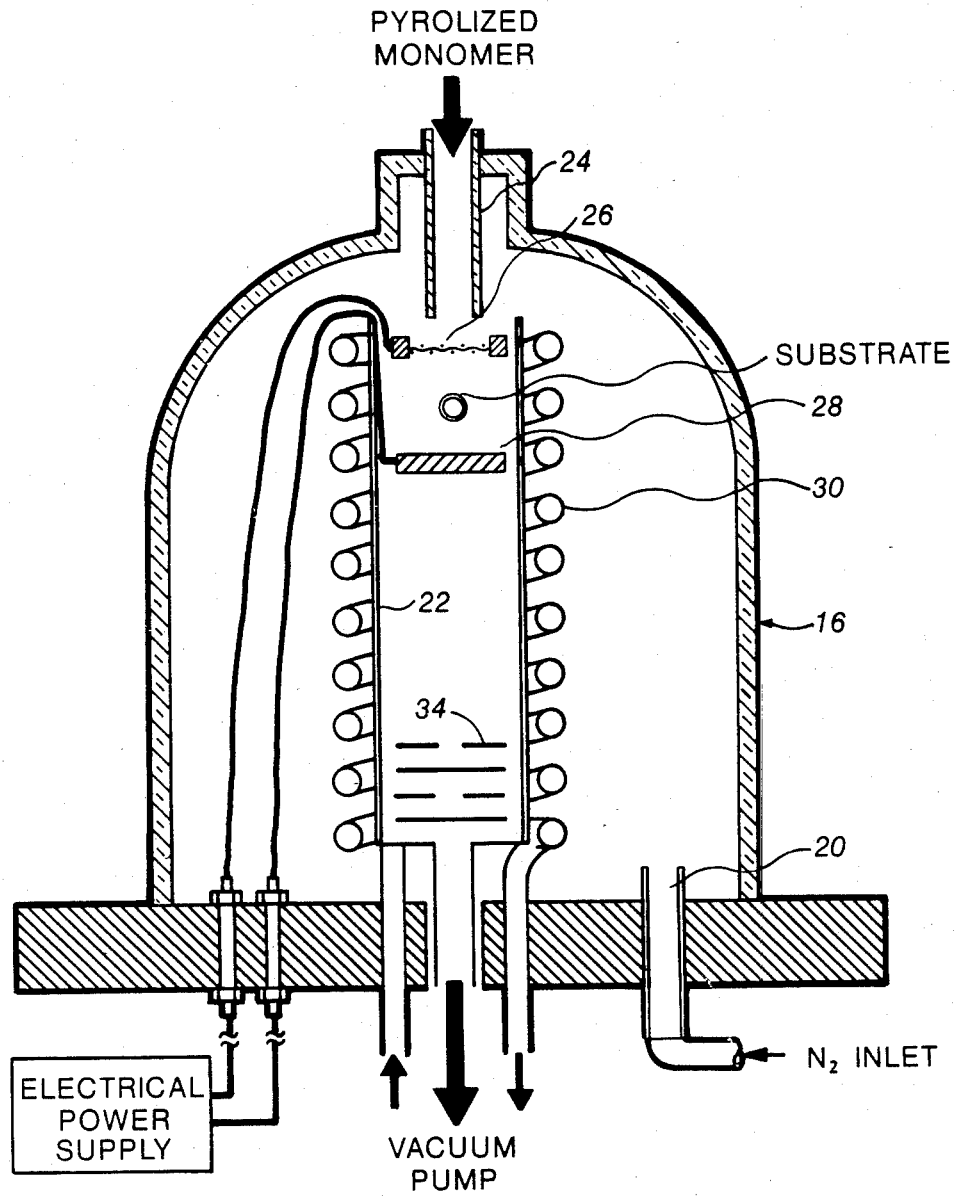
FIG. 2 is an illustration of the deposition chamber of the apparatus of FIG. 1, particularly including the plasma electrodes.

The sublimed dimer passes along the tube 11 to a pyrolysis furnace 14 which is maintained at approximately 600° C. This temperature is the preferred operating temperature. However, pyrolysis of the substituted and unsubstituted p-xylylenes occurs and may be conducted at varying rates over a range of temperatures of from about 450° to 700° C. From the pyrolysis furnace 14 the sublimed and pyrolyzed monomer vapors pass into a deposition chamber 16, which is illustrated in further detail in FIG. 2. The deposition chamber 16 consists essentially of a modified bell jar which contains the article to be coated and a pair of plasma electrodes.

The system is evacuated by means of a vacuum pump (not shown), which evacuates the deposition chamber 16 as well as the tube 11 through a central opening in the floor of the deposition chamber 16. The pressure of the system is maintained at a predetermined desired value by a pressure regulator 18 which bleeds nitrogen into the deposition chamber through an inlet 20 to maintain the system at the selected pressure. In the illustrated preferred embodiment, nitrogen is used to maintain the system pressure. However, other inert gases may be used. System pressures of between 10 and 300 millitorr are satisfactory. However, the preferred range of system pressures is from 50 to 100 millitorr, with the most preferred pressure being approximately 90 millitorr. The temperature of the substrate is preferably maintained at approximately −30° to −45° C. by means of a coolant coil, described further below.

It will be appreciated that the pyrolyzed monomer vapors produced at high temperature in the pyrolysis furnace 14 tend to condense and polymerize on any relatively cool surface that they may contact. In order to minimize accumulation of the resulting polymeric film on the inside surface of the deposition chamber and other surfaces where it is not desired, the flow of the polymerized monomer vapor is to some extent guided through the deposition chamber by means of a vertical copper tube 22 which is centered over the exhaust opening in the floor of the chamber 16. The pyrolyzed monomer vapors enter the deposition chamber 16 through a glass elbow tube 24 which is directed toward the vertical tube 22 and which terminates just above the top of the tube 22. By slowly bleeding nitrogen into the deposition chamber and at the same time evacuating the chamber through the bottom of the tube 22, the flow of pyrolyzed monomer vapors is at least partially confined to the bore of the copper tube 22.

Samples to be coated with the film are positioned between a pair of electrodes 26 and 28 which are located inside the upper end of the copper tube 22. The upper electrode 26 consists of a circular wire mesh screen mounted in a plastic retaining ring. The wire screen functions in a dual capacity as an electrode and also to disperse the monomer vapors as they flow out of the glass tube 24 and down the vertical copper tube 22. The lower electrode 28 consists of a circular brass plate which serves both as an electrode and as a supporting platform for samples to be coated. As an indication of the scale of the drawings, the electrodes 26 and 28 are each approximately two inches in diameter.

Samples may be mounted in any convenient manner on the lower electrode 28, or in any other suitable manner in the region between the two electrodes where the plasma is formed. In one particular application for which the present invention was developed, glass and metal microspheres, on the order of a few hundred microns or less in diameter, are mounted on very thin glass stalks. The stalks are mounted in an upright position by inserting them in holes bored in the lower electrode. In this manner the microspheres are positioned between the two electrodes where they can be evenly coated with the poly-p-xylyene film.

The electrodes, the plasma and any substrate contained between the electrodes are cooled by means of a helical coolant coil 30 which encircles the vertical copper tube 22. In the preferred embodiment gaseous nitrogen is chilled with liquid nitrogen in a dewar flask 32 (FIG. 1) and pumped through the coolant coil 30. The coolant coil also cools a set of metal baffles 34 which are located at the bottom end of the vertical copper tube 22 and which operate to partially collect the monomer vapors so that they do not pass into the vacuum pumping system.

The pyrolyzed p-xylylene monomer that passes through the wire mesh upper electrode is exposed to a low-temperature, low-pressure plasma which is produced by applying across the two electrodes an alternating potential having a frequency of approximately 30 to 300 hertz (Hz), a voltage of 150 to 500 volts and a current of 0.05 to 2.0 milliamps. This potential partially ionizes the nitrogen in a region between the electrodes. It is presently unknown to what extent the vaporized and pyrolyzed p-xylylene monomer is directly ionized or otherwise affected by the alternating electrical field between the electrodes; and it is also unknown exactly how the ionized nitrogen and the p-xylylene monomer interact in the plasma zone. Chemical analysis of the deposited film has shown that the film contains only a trace amount (approximately 0.2%) of nitrogen.

Figure 3:
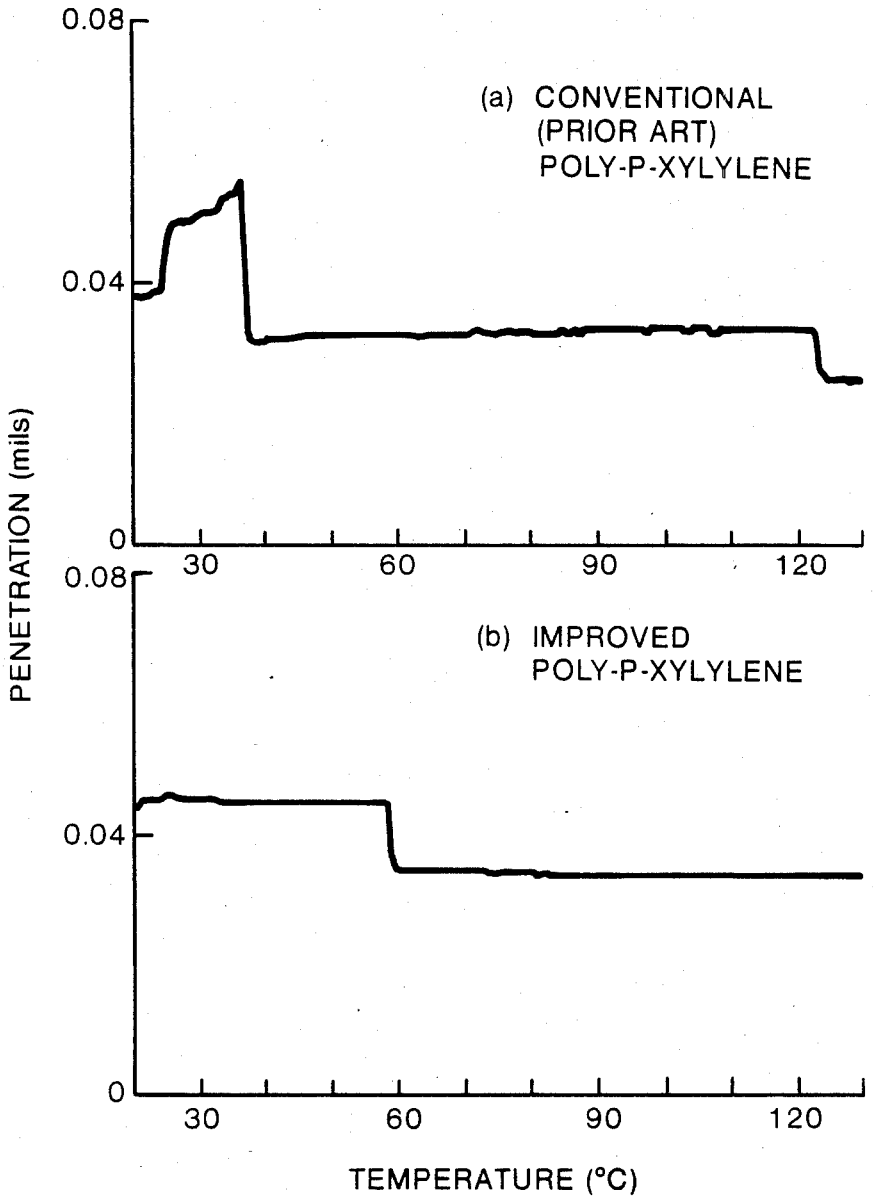
FIG. 3 is a graphical presentation of the thermal stability test results which compare the improved film of the present invention with a film made according to a previously known method.

The thermal stability of the poly-p-xylylene produced by the method of this invention has been compared with that of a poly-p-xylylene prepared by a conventional method. The comparison consisted of two identical penetration tests, in which the penetration of a stylus into a pair of poly-p-xylylene coatings was monitored as temperature of the coating was raised. The results are presented in FIG. 3, in which the penetration of the stylus is plotted as a function of the temperature of the coating. FIG. 3(*a*) represents the conventional coating and FIG. 3(*b*) represents the coating prepared according to the present invention. Both coatings were prepared from the same monomer material, which was di-p-xylylene obtained from Union Carbide Company and identified as DPX-N di-p-xylylene. It will be noted that in each case the stylus actually rises initially due to thermal expansion of the hardened coating. In the prior art coating this expansion is much more pronounced, which is thought to be due to a lack of cross-linking in the coating. It will be further noted that the prior art coating of FIG. 3(*a*) abruptly softens and permits penetration of the stylus at a temperature of approximately 36° C., whereas the coating of FIG. 3(*b*) does not soften until a temperature of almost 60° C. is attained.

The poly-p-xylylene coating of the present invention has also been tested against previously known coatings with respect to solubility in certain organic solvents. Specifically, the solubility in benzyl benzoate has been tested. At 240° C. the prior art coating material is completely soluble in benzyl benzoate, whereas the coating material prepared by the method of the invention is only slightly soluble. Likewise, the poly-p-xylylene of the present invention is only slightly soluble in alpha-chloro-napthalene at 240° C., whereas the prior art material is very soluble in this solvent under the same conditions.

EXAMPLE 1

In a demonstration run (#410) of the method described above, 2.0 grams of di-p-xylylene monomer were used to form a poly-p-xylylene coating on a number of berylium-copper spheres having a diameter of approximately half a millimeter. The monomer was sublimed and pyrolyzed over a total period of 2 hours, 55 minutes. During the first 50 minutes of this period the sublimation and pyrolysis furnaces were progressively heated to temperatures of 100° and 610° C., respectively. During the remainder of the period the sublimation furnace was gradually heated to a maximum temperature of 214 degrees, while the pyrolysis furnace was maintained at approximately 600 degrees. After the first hour and twenty minutes the plasma electrodes were actuated with a 60 Hz potential having an ac voltage of 500 to 600 volts and a current of between 0.11 and 0.14 milliamps. System pressure was maintained at approximately 88 millitorr by maintaining a flow of nitrogen of approximately 28 sccm (standard cubic centimeters per minute) through the plasma chamber. All of the starting material was sublimated and pyrolyzed and produced coatings having measured thicknesses of between 69 and 74 micrometers.

EXAMPLE 2

In another demonstration run (#416), 3.7 grams of monomer were sublimed and pyrolyzed over a period of approximately five hours. The pyrolyzed monomer vapor was passed through the plasma chamber operated at 60 Hz, a voltage of between 485 and 685 volts, and a current of between 0.22 and 0.11 milliamps. The system pressure was maintained at approximately 88 millitorr by admitting nitrogen to the system as necessary, typically at a flow of approximately 20 to 28 sccm.

The monomer vapor was deposited onto a set of twelve mounted beryllium-copper microspheres having diameters of approximately 380 microns. The spheres were cooled to approximately −50° C. with the liquid nitrogen cooling system. The average measured coating thickness was 129 microns.

EXAMPLE 3

In another demonstration run (#341), a relatively large charge of 150 grams of di-p-xylylene was sublimed and pyrolyzed over a relatively long period of 42 hours. During the major portion of this period the sublimation furnace was maintained at 110° to 150° C., and during all but the first hour of this period the pyrolysis furnace was maintained at approximately 600° C. The system pressure was maintained at 88 to 92 millitorr by bleeding nitrogen into the system at a rate of 25 to 30 sccm. The substrate in this case consisted of nine microspheres mounted on thin glass stalks. The microspheres range in diameter from 258 to 363 microns. As was expected with such a large charge deposited over a long time period, the resulting films on the microspheres were relatively thick, ranging in thickness from 448 to 515 microns. In addition to the film formed on the substrate spheres, the film material was deposited extensively on the walls and other surfaces of the deposition chamber, and almost completely clogged the upper screen mesh.

EXAMPLE 4

In another demonstration run (#342), a one-quarter gram charge of di-p-xylylene was used to form a film of poly-p-xylylene on a film of boron oxide. The boron oxide film was supported on a section of large-mesh copper screen, which was in turn mounted between the plasma electrodes of the deposition apparatus. The di-p-xylylene charge was sublimed completely over a 1.5 hour period by increasing the temperature of the sublimation furnace steadily from room temperature (23° C.) to 204° C. The pyrolysis furnace was heated to 600° C. System pressure was maintained at 88 millitorr with a nitrogen bleed rate of 27 sccm. The thickness of the poly-p-xylylene component of the resulting composite boron oxide/poly-p-xylylene film was determined to be approximately 0.075 micron, using a stylus step measuring device.

EXAMPLE 5

In another demonstration run (#357), a charge of 5.0 grams of di-p-xylylene was used to coat two unmounted one-millimeter beryllium-copper spheres. The dimer was sublimated over a period of 3.25 hours at a temperature which was gradually increased to a maximum of 184° C. The pyrolysis furnace was maintained at 600° C. The coolant coil was cooled to −100° C. System pressure was maintained at 87 to 89 millitorr with a nitrogen bleed rate of 38 sccm. The plasma field was generated with a 60 Hz, 125 volt potential. The resulting poly-p-xylylene films on the two spheres had measured thicknesses of 19.2 and 21.7 microns.

EXAMPLE 6

In another demonstration run (#427), a charge of 1.70 grams of di-p-xylylene was used to coat 200 μm diameter copper wires. The dimer was sublimed over a period of 3 hours to a maximum of 213° C. The pyrolysis furnace was maintained at 600° C. The coolant coil was cooled to −50° C. System pressure was maintained at 88 millitorr with a nitrogen bleed. The plasma field was generated with a 60 Hz, 125 volt potential at 0.18 ma. The resulting poly-p-xylylene films on the wires measured 25–30 microns.

EXAMPLE 7

In another demonstration run (#401), a charge of 0.50 grams of di-p-xylylene was used to coat 3 mm dia. gold discs. The dimer was sublimed over a period of 2 hours at a temperature which was gradually increased to a maximum of 163° C. The pyrolysis furnace was maintained at 600° C. The coolant coil was cooled to −47. System pressure was maintained at 89 to 90 millitorr with a nitrogen bleed rate of 32 sccm. The plasma field was generated with a 60 Hz, 125 V potential at 0.5 ma. The resulting poly-p-xylylene films on the discs measured 5.5 microns. Yet another demonstration run was done under the same conditions using 3 mm dia. molybdenum discs with identical results.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method of making a polymerized p-xylylene film, comprising the steps of:

subliming a solid di-p-xylylene at a first temperature to produce a sublimed di-p-xylylene vapor;

pyrolyzing said sublimed di-p-xylylene vapor at a second temperature higher than said first temperature to produce a p-xylylene vapor;

introducing said p-xylylene vapor into a deposition region wherein a low-temperature, low-pressure plasma is generated by means of an alternating electrical field applied to an inert gas in said region at a frequency of between approximately 30 and 300 hertz; and condensing said p-xylylene vapor onto a solid substrate located within said deposition region.

2. The method of claim 1 wherein said low-pressure plasma is formed in nitrogen at a pressure of between approximately 10 and 300 millitorr.

3. The method defined in claim 1 wherein said p-xylylene vapor is passed through a plasma consisting of nitrogen at a pressure of between 10 and 300 millitorr excited by a 30 to 300 hertz alternating potential at approximately 150 to 500 volts.

4. The method of claim 1 wherein said low-pressure plasma is formed in argon at a system pressure of between approximately 10 and 300 millitorr.

5. The method of claim 1 wherein said substrate is cooled to approximately −30° to −45° C. prior to condensing said p-xylylene vapor onto said substrate.

6. The method defined in claim 1 wherein said first temperature is between approximately 100° and 250° C.

7. The method of claim 6 wherein said second temperature is between 450° and 700° C.

8. The method of claim 7 wherein said second temperature is approximately 600° C.

9. The method defined in claim 1 wherein said alternating electrical field is applied at a potential of between approximately 150 and 500 volts.

10. The method defined in claim 9 wherein said plasma is formed in nitrogen at a pressure of between approximately 10 and 300 millitorr.

* * * * *